United States Patent [19]

Russell

[11] Patent Number: 4,484,593

[45] Date of Patent: Nov. 27, 1984

[54] AUTOMATIC MILK BULK TANK LOCKOUT SYSTEM AND METHOD OF USING SAME

[76] Inventor: Merton Russell, Rte. 1, Box 319, Endeavor, Wis. 53930

[21] Appl. No.: 394,619

[22] Filed: Jul. 2, 1982

[51] Int. Cl.[3] ..... B67D 5/02

[52] U.S. Cl. ..... 137/1; 137/624.11; 73/863.01; 73/863.83; 366/140

[58] Field of Search ..... 137/624.11, 624.18; 366/140; 73/863.01, 863.83, 864.34

[56] References Cited

U.S. PATENT DOCUMENTS

| | | | |
|---|---|---|---|
| 2,875,590 | 3/1959 | Girton . | |
| 2,875,591 | 3/1959 | Girton . | |
| 3,435,247 | 3/1969 | Pfeiffer | 137/624.11 X |
| 3,731,494 | 5/1973 | Fleck . | |
| 4,292,994 | 10/1981 | Johnson | 137/565 X |

*Primary Examiner*—Alan Cohan

*Attorney, Agent, or Firm*—Isaksen, Lathrop, Esch, Hart & Clark

[57] ABSTRACT

An automatic milk bulk tank lockout system (10) for use with a milk agitator (12) in a stationary bulk tank (14) and a pump (18) in a milk tank truck (16) for pumping milk out of the bulk tank (14) includes an electrical receptacle (22) adapted to supply power to the pump (18). A second timer switch (42) driven by a timing motor (28) is adapted to activate an agitator relay (46) to direct electrical current to the milk agitator (12) for a selected period of time. A third timer switch (44) also driven by the timing motor (28) selectively activates the receptacle (22) in automatic coordination with the operation of the milk agitator (12). The receptacle (22) is deactivated throughout the agitating period. Thereafter it is activated, whereby the pump (18) is not powered and milk cannot be pumped out of the bulk tank (14) before expiration of the selected agitating period. Preferably, the third timer switch (44) controls a receptacle relay (48) through which electrical current is directed to the receptacle (22), activating it.

22 Claims, 2 Drawing Figures

AUTOMATIC MILK BULK TANK LOCKOUT SYSTEM AND METHOD OF USING SAME

TECHNICAL FIELD

This invention relates to controls for milk bulk tank pumping systems in general and, in particular, to controls adapted to ensure that milk in a bulk tank is properly agitated before samples of the milk are taken for butterfat measurement and the milk is pumped to a tank truck.

TECHNICAL BACKGROUND

In dairy farming operations, milk from the dairy herd conventionally is stored in a refrigerated milk bulk tank. Periodically, the milk in the bulk tank is transferred to a milk tank truck for delivery to a dairy, cheese factory, or the like. Such trucks typically collect milk from several farms, all of which milk is combined within the single tank of the truck.

The price received by the farmer for his milk is determined in part by the butterfat content of the milk. Because the milk is mixed in the tank truck with that of other farmers, it is necessary to obtain samples of the milk for measurement of butterfat before it is transferred from the bulk tank to the truck. Butterfat tends to float to the top of the unhomogenized milk in the bulk tank. Consequently, it is necessary to stir or otherwise agitate the milk before the sample is taken so that the butterfat is uniformly redistributed through the milk and the sample taken is typical of the whole. Conventionally, the milk tank truck driver activates an agitator within the bulk tank for a standardized length of time, usually from 5 to 10 minutes, before taking the sample and then pumping the bulk tank out.

Problems arise when inattentive or hurried tank truck drivers agitate the milk in the bulk tank for an insufficiently long period of time before sampling it. The sample is conventionally taken from the midst of the tank. Consequently, when the milk has not been thoroughly agitated, the sample is at best inaccurate. Typically it contains less butterfat than it would if the agitation had been carried on for the prescribed length of time, leading to a low price for the milk.

The technical field is generally cognizant of the need to control the agitation of milk in a farm bulk milk tank and the like for various reasons. Fleck, U.S. Pat. No. 3,731,494 provides for the timed agitation of milk in a bulk tank for various purposes. Fleck further provides for the automatic agitation of milk when the temperature of the milk is above a selected level. A manual control is provided for timed agitation of the milk prior to the taking of butterfat samples, the manual control being adapted to override the automatic, temperature responsive control. Girton, et al., U.S. Pat. Nos. 2,875,590 and 2,875,591 disclose a system for interconnecting the agitating and cooling functions of a milk bulk tank, providing for an interlock between cooling and agitating functions and a weighing function of the device shown.

The technical field is not cognizant of means for preventing the removal of milk from a milk bulk tank before agitation of the milk sufficient to ensure that a reliable butterfat sample may be taken.

BRIEF SUMMARY OF THE INVENTION

The present invention is summarized in that an automatic milk bulk tank lockout system for use with the milk agitator in a stationary bulk tank and a pump in a milk tank truck for pumping milk out of the bulk tank includes an electrical receptacle to supply power to the pump. Means are provided for activating the milk agitator for a selected, timed agitating period. Means are also provided for selectively activating the receptacle in automatic coordination with the milk agitator so as to deactivate the receptacle throughout the agitating period and then to activate the receptacle, whereby the pump is not powered and milk cannot be pumped out of the milk tank before expiration of the selected agitating period.

The method of the invention for preventing the operation of a pump for pumping milk from a milk bulk tank until after an agitator has agitated the milk for a selected agitating period includes connecting the pump to a receptacle adapted to power the pump. The milk agitator is then activated for the selected agitating period. The method further includes activating means for directing electrical current to the receptacle in automatic coordination with the agitator so as to deactivate the receptacle throughout the agitating period and thereafter to activate the receptacle to power the pump.

A primary object of the invention is to provide means for preventing the pumping of milk from a milk bulk tank until the milk has been agitated to a desired extent.

A second object of the invention is to provide such means that will operate automatically without requiring the attention of the driver of the milk tank truck or any other operator.

Another object of the invention is to provide means for disabling the milk pump of a milk tank truck for a selected period of time in order to prevent the premature removal of milk from a bulk tank.

A further object of the invention is to provide such an automatic system as has been referred to above that also contains means for manually overriding the automatic regulation of the agitation of the milk and of the operation of the milk pump.

A further object of the invention is to provide status indicators whereby the status of the automatic milk bulk tank lockout system may be perceived at a glance.

Other objects, features, and advantages of the invention will be apparent from the following detailed description taken in conjunction with the accompanying drawings showing a preferred embodiment of the automatic milk bulk tank lockout system of the invention.

DETAILED DESCRIPTION OF THE PREFERRED EMBODIMENT

Figure 1:
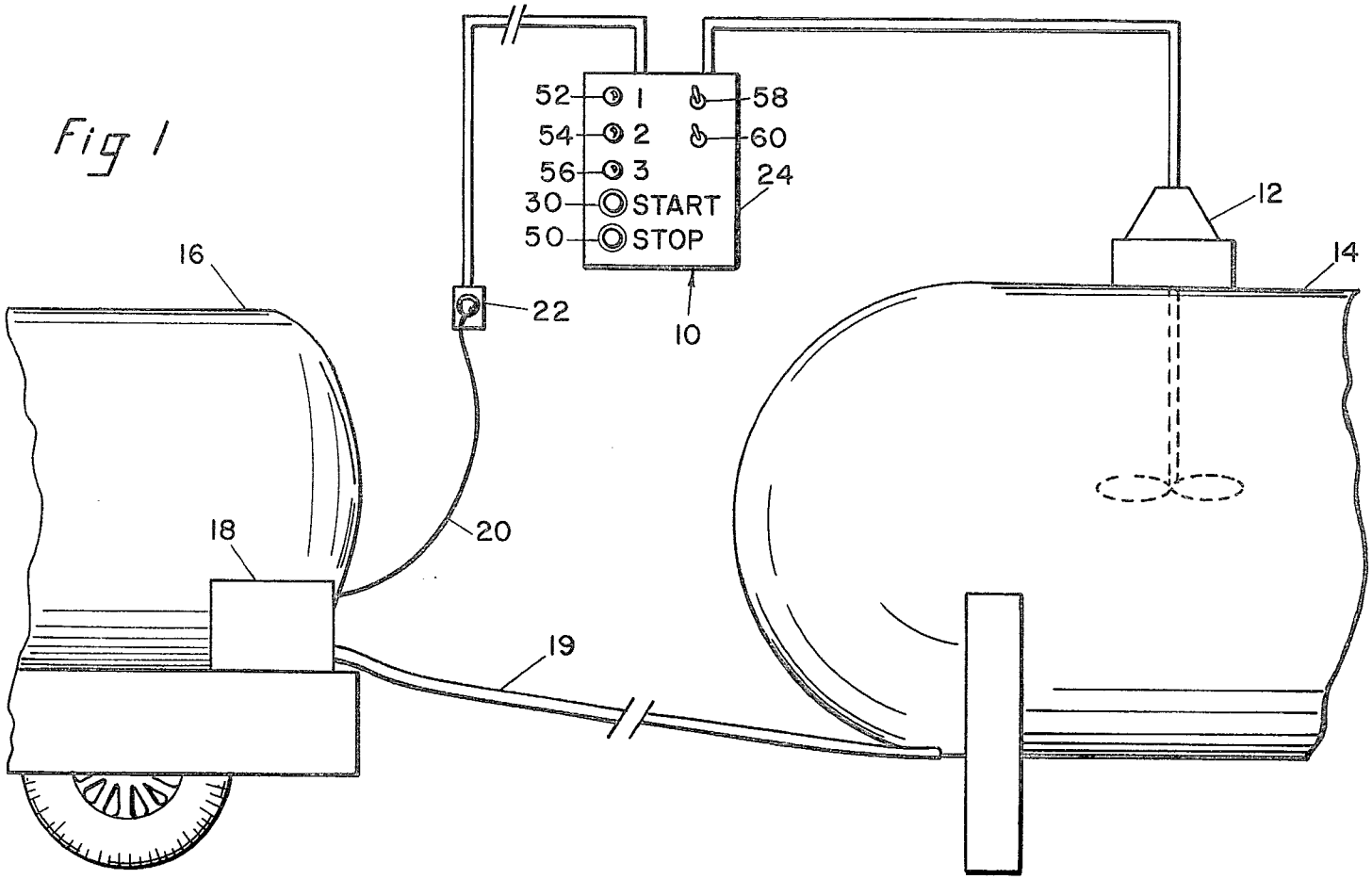
FIG. 1 is a semi-schematic representation of an embodiment of the automatic milk bulk tank lockout system of the invention.

Referring more particularly to the drawings, wherein like numbers refer to like parts, FIG. 1 shows an automatic milk bulk tank lockout system, shown generally at 10, for use with a milk agitator 12 located in a stationary bulk tank 14 used in a dairy operation as a holding tank for the milk from one or more milkings. The bulk tank 14 is adapted to be emptied periodically by a milk tank truck 16 after the milk is sampled for butterfat. The milk tank truck 16 is equipped with an electrical pump 18 having a hose 19 adapted to be coupled to the bulk tank 14 to pump milk therefrom. The pump 18 has a power cord 20 adapted to be plugged into and receive power from an electrical receptacle 22 specifically provided for that purpose.

The milk must be stirred with the milk agitator 12 before the milk is sampled to mix the butterfat through the milk to ensure that the sample taken is typical of the whole. The agitating period necessary to reliably distribute the butterfat through the milk may extend for some minutes, typically for 5 to 10 minutes with the bulk tanks 14 and milk agitators 12 commonly in use. As is discussed above, it is important to the interests of the dairy operation selling the milk that the agitating period not be shortened. Milk samples are taken well beneath the surface of the milk, so that stirring insufficient to mix the floating butterfat throughout the milk leads to a low reading for butterfat and a low price for the milk.

The automatic milk bulk tank lockout system 10 of the invention has an electrical receptacle 22 and a control unit 24. The receptacle 22 is conventional in design and may be installed at a place convenient for use by the tank truck operator. The control unit 24 may be manufactured as a self-contained unit that can be mounted on the wall of the room containing the bulk tank 14 or at any convenient place. Any conventional electrical milk agitator 12 may then be connected to the control unit 24 in the manner disclosed below.

The control unit 24 is adapted to go through a timed lockout cycle in which it first withholds power from the electrical receptacle 22 until the milk agitator 12 has been activated for a selected, timed agitating period. After the expiration of the agitating period, the control unit 24 withholds power from the receptacle 22 for an additional sampling period selected to be long enough to allow the milk in the bulk tank 14 to be sampled. Thereafter, the control unit 24 activates the receptacle 22, thereby supplying power to the pump 18. The tank truck operator may then pump the milk from the bulk tank 14 to the tank truck 16, and proceed on his way.

Figure 2:
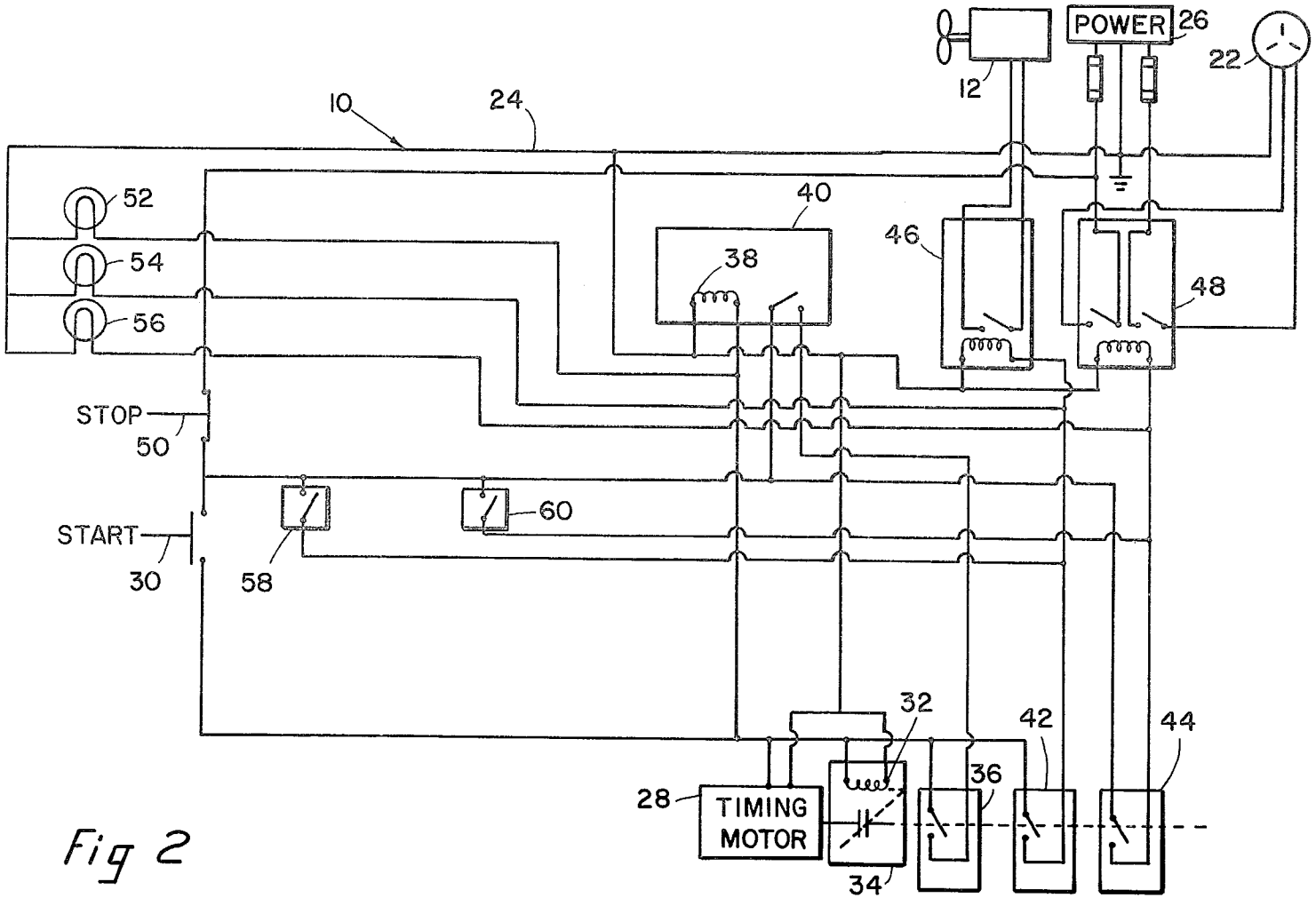
FIG. 2 is a schematic wiring diagram of the automatic milk bulk tank lockout system of the invention.

The control unit 24 is connected to a power source 26, shown schematically in FIG. 2. The control unit 24 includes an electrical timing motor 28 that drive various elements of the control unit 24 through the timed lockout cycle. A start switch 30 is biased in an open position and is adapted to be manually activated to close a circuit supplying electrical current from the power source to the timing motor 28, thus providing means for momentarily supplying an initial electrical current to the timing motor. The start switch 30 also directs electrical current to a timing motor clutch coil 32 adapted to activate and thus engage a timing motor clutch 34. The clutch 34 is engaged only when electrical current is directed to the clutch coil 32. The clutch 34 engages the timing motor 28 with a first timer switch 36. The first timer switch 36 is preferably a cam actuated switch adapted to close substantially immediately upon being driven by the timing motor 28.

The start switch 30 also directs electrical current to a control relay coil 38 to activate and thus close a control relay 40. Electrical current from the power source 26 is directed through the closed control relay 40 and on through the closed first timer switch 36 to the timing motor 28, clutch coil 32, and control relay coil 38. Thus, the control relay 40 and timing motor 28 will continue to be activated by electrical current after the start switch 30 no longer supplies the initial electrical current. Likewise, current will continue to be directed to the clutch coil 32, so that the timing motor clutch 34 will continue to be engaged and the first timer switch 36 driven and thus maintained in its closed position.

The lockout system 10 also has second and third timer switches 42, 44 that are cam actuated timer switches preferably driven by the timing motor 28. The timing motor 28 is engaged with the second and third timer switches 42, 44 by means of the timing motor clutch 34. Preferably, the first, second, and third timer switches 36, 42, 44 are mechanically coupled so that all three operate together.

The second timer switch 42 is adapted to close preferably immediately upon being driven by the timing motor 28. It is adapted to remain closed for the selected agitating period and then to open. An electrical current from the power source 26 is directed through the closed second timer switch 42 to activate an agitator relay 46, causing it to close. An electrical current drawn from a convenient power source (not shown) then passes through the closed agitator relay 46 to activate the milk agitator 12. Thus, the driven second timer switch 42 and agitator relay 46, together with the electrical currents operating and controlled thereby constitute means for activating the milk agitator 12 for the selected, timed agitating period.

The third timer switch 44 is adapted to close at a selected time after the second timer switch 42 opens. Preferably, the closing of the third timer switch 44 is delayed after the opening of the second timer switch 42 until a selected sampling period has expired. Electrical current drawn from the power source 26 is directed through the closed third timer switch 44 to activate a receptacle relay 48, causing it to close. Electrical power drawn from the power source 26 is directed through the closed receptacle relay 48 to the electrical receptacle 22 to power the pump 18. Thus, the interacting second and third timer switches 42, 44 and associated agitator and receptacle relays 46, 48 provide means for activating the receptacle 22 in automatic coordination with the milk agitator 12.

Preferably the first, second, the third timer switches 36, 42, 44 each have an initial open position at the beginning of the timed lockout cycle, just prior to activation of the start switch 30. Furthermore, the timer switches 36, 42, 44 preferably are also adapted to return to their initial, open positions automatically when the timing motor 28 ceases to drive them. The first timer switch 36 may be adapted to open after the expiration of a selected pumping period following the closing of the third timer switch 44. The opening of the first timer switch 36 interrupts the flow of electrical current to the clutch coil 32, control relay coil 38, and timing motor 28. Consequently, the control relay 40 opens, the timing motor clutch 34 disengages the timing motor 28 from the timer switches 36, 42, 44, and the timing motor 28 stops, concluding the timed lockout cycle. The timer switches 36, 42, 44 return automatically to their initial, open positions, whereupon the lockout system 10 is returned to its initial configuration.

Either alternatively or in addition to the timed opening of the first timer switch 36 just disclosed, a stop switch 50 may be provided to interrupt the flow of electrical current passing through the closed control relay 40 and closed first timer switch 36 to the control relay coil 38, clutch coil 32, and timing motor 28. The lockout system 10 may thus be brought to a halt and automatically returned to its initial configuration by a sequence of events comparable to that just disclosed as occurring upon the opening of the first timer switch 36.

First, second, and third indicator lights 52, 54, 56 are adapted to be energized respectively when the control relay 40, milk agitator 12, and receptacle 22 are activated. This may be conveniently accomplished by wiring the first, second, and third indicator lights 52, 54, 56 in parallel with the control relay 40, agitator relay 46, and receptacle relay 48, respectively.

Preferably first and second manual switches 58, 60 are adapted to direct electrical current from the power source 26 to activate the agitator relay 46 and receptacle relay 48, respectively, independent of any timer switch. By this means, those relays may be closed independent of any time sequence and the milk agitator 12 and electrical receptacle 22 furnished with electrical current at will.

While the preferred embodiment of the invention is as disclosed above, many alternative embodiments are possible within the scope and spirit of the invention. Thus, an electronic rather than mechanical timing system could be used with equal facility. Electronic switches of various sorts could be substituted for the cam actuated timer switches 36, 42, 44. The timer switches 36, 42, 44 could each be driven by an independent timing motor. When cam controlled timer switches are employed, or any equivalent timer switch that can be made to operate in a cyclical fashion, a single timed lockout cycle can be made to coincide with the entire cycle of the timer switches, whereupon the switches will have returned to their initial positions at the end of a timed lockout cycle without the need for any other self-returning mechanism in the switches. Similarly, while the stop switch 50, indicator lights 52, 54, 56 and first and second manual switches 58, 60 are useful and contribute significantly to the function of the lockout system 10, many of the principal advantages of the lockout system may be obtained without their incorporation therein.

The method of the invention for preventing the operation of a pump 18 for pumping milk from a milk bulk tank 14 until after a milk agitator 12 has agitated the milk for a selected agitating period includes connecting the pump to a receptacle 22 adapted to power the pump. The receptacle 22 and milk agitator 12 are then controlled relative to each other by the control unit 24 described above to activate the milk agitator for the selected agitating period and to direct electrical current to the receptacle in automatic coordination with the agitator so as to deactivate the receptacle throughout the agitating period and thereafter to activate it to power the pump 18.

It is understood that the present invention is not limited to the particular construction and arrangement of parts illustrated and disclosed nor to the particular steps disclosed herein. Instead, it embraces all such modified forms thereof as come within the scope of the following claims.

What is claimed is:

1. An automatic milk bulk tank lockout system (10) for use with a milk agitator (12) in a stationary bulk tank (14) and a pump (18) in a milk tank truck (16) for pumping milk out of the bulk tank (14), the lockout system (10) comprising:

an electrical receptacle (22) to supply power to the pump (18); and, as a substantially unitary installation adapted to be mounted remote from the milk tank truck (16):

means for activating the milk agitator (12) for a selected, timed agitating period; and means for selectively activating the receptacle (22) in automatic coordination with the milk agitator (12) so as to deactivate the receptacle (22) throughout the agitating period and then to activate the receptacle (22), whereby the pump (18) is not powered and milk cannot be pumped out of the bulk tank (14) before expiration of the selected agitating period.

2. The lockout system (10) of claim 1 including means for initiating a timed lockout cycle, including a timing motor (28), first timer switch (36), control relay coil (38), and control relay (40), and including means for momentarily supplying an initial electrical current to and thus activating (a) the timing motor (28), which is adapted to drive the first timer switch (36), moving the first timer switch (36) into a closed position; and (b) the control relay coil (38) to activate and thus close the control relay (40) and thereby supply electrical current that is directed through the closed first timer switch (36) to the timing motor (28) and the control relay coil (38), whereby the control relay (40) and timing motor (28) will continue to be activated after the initial electrical current is no longer supplied by the initiating means.

3. The lockout system (10) specified in claim 2 including a second timer switch (42) driven by the timing motor (28) and adapted when closed to direct electrical current to and thus activate the milk agitator (12), the second timer switch (42) being adapted to close for the selected agitating period and then to open, deactivating the milk agitator (12).

4. The lockout system (10) specified in claim 3 wherein the means for activating the receptacle (22) in automatic coordination with the milk agitator (12) includes a third timer switch (44) driven by the timing motor (28) and adapted to close at a selected time after the second timer switch (42) opens and, when in its closed position, to direct electrical current to and thus activate the receptacle (22) and power the pump.

5. The lockout system (10) specified in claim 4 wherein the first, second, and third timer switches (36, 42, 44) each have an initial open position at the beginning of the timed lockout cycle and are adapted to return to their initial open positions automatically when the timing motor (28) ceases to drive them.

6. The lockout system (10) specified in claim 5 including a timing motor clutch (34) adapted to engage the timing motor (28) with the first, second, and third timer switches (36, 42, 44) only when the timing motor (28) is activated, and wherein the first timer switch (36) is adapted to open after the third timer switch (44) has been closed for a selected time to interrupt the electrical current directed through the first timer switch (36) to the timing motor (28) and to the control relay coil (38), so that the timing motor (28) is deactivated, whereupon the clutch (34) disengages so that the timing motor (28) ceases to drive the first, second, and third timer switches (36, 42, 44) which then return to their initial positions, and the control relay (40) is deactivated and thus opens, restoring the lockout system (10) to its initial configuration.

7. The lockout system (10) specified in claim 5 including a manually actuated stop switch (50) adapted to interrupt the flow of electrical current passing through the closed control relay (40) and closed first timer switch (36) to the timing motor (28) and to the control relay coil (38), whereupon the control relay (40) opens and the timing motor (28) ceases to drive the first, second, and third timer switches (36, 42, 44), which then return to their initial positions, so that the lockout system (10) is restored to its initial configuration.

8. The lockout system (10) specified in claim 4 including an agitator relay (46) and receptacle relay (48), and wherein the second and third timer switches (42, 44), when in their closed positions, direct electrical current to and thus activate the agitator relay (46) and receptacle relay (48), respectively, which then direct electrical current of a selected voltage to the agitator (12) and receptacle (22), respectively.

9. The lockout system (10) specified in claim 4 including first, second, and third indicator lights (52, 54, 56), adapted to be energized respectively when the control relay (40), agitator (12), and receptacle (22) are activated.

10. The lockout system (10) specified in claim 4 including first and second manual switches (58, 60) adapted to direct electrical current to the agitator (12) and receptacle (22) respectively, independent of any timer switch.

11. An automatic milk bulk tank (14) lockout system (10) for use with a milk agitator (12) in a stationary bulk tank (14) and a pump (18) in a tank truck (16) for pumping milk out of the milk bulk tank (14), the lockout system (10) comprising:

an electrical receptacle (22) to supply power to the pump (18), the electrical receptacle being selected to be of a standard design of common and unspecified application; and, as a substantially unitary installation adapted to be mounted remote from the tank truck (16):

a timing motor (28), start switch (30), first timer switch (36), control relay coil (38), and control relay (40), the start switch (30) being adapted to momentarily supply an initial electrical current to and thus activate the timing motor (28), which is adapted to drive the first timer switch (36), moving the first timer switch (36) into a closed position, and the control relay coil (38) to activate and thus close the control relay (40) and thereby supply electrical current that is directed through the closed first timer switch (36) to the timing motor (28) and the control relay coil (38), whereby the control relay (40) and timing motor (28) will continue to be activated after the initial electrical current is no longer supplied by the start switch (30);

a second timer switch (42) driven by the timing motor (28) and adapted when closed to direct electrical current to and thus activate the milk agitator (12), the second timer switch (42) being adapted to close for the selected agitating period and then to open, deactivating the milk agitator (12); and a third timer switch (44) driven by the timing motor (28) and adapted to close at a selected time after the second timer switch (42) opens and, when in its closed position, to direct electrical current to and thus activate the receptacle (22) and power the pump (18), whereby the pump (18) is not powered and milk cannot be pumped out of the bulk tank (14) before expiration of the selected agitating period.

12. The lockout system (10) specified in claim 4 or 11 wherein the third timer switch (44) is adapted to close after a selected sampling period has expired following the deactivation of the milk agitator (12).

13. A method for preventing the operation of a pump (18) mounted on a tank truck (16) for pumping milk from a milk bulk tank (14) until after an agitator (12) has agitated the milk for a selected agitating period, comprising the steps of:

(a) connecting the pump (18) to a receptacle (22) adapted to power the pump (18), said receptacle 22 being of a selected standard design of common, unspecified application;

(b) activating the milk agitator (12) for the selected agitating period;

(c) activating means for directing electrical current to the receptacle (22) in automatic coordination with the agitator (12), said activating means being located at a location remote from the tank truck (16), so as to deactivate the receptacle (22) throughout the agitating period and thereafter to activate the receptacle (22) to power the pump (18) utilizing means independent of the tank truck (16).

14. The method specified in claim 13 wherein the step of activating the milk agitator (12) for the selected agitating period includes momentarily supplying an initial electrical current to and thus activating (a) a timing motor (28) adapted to drive a first timer switch (36), moving the first timer switch (36) into a closed position; and (b) a control relay coil (38) to activate and thus close a control relay (40) and thereby supply electrical current that is directed through the closed first timer switch (36) to the timing motor (28) and the control relay coil (38), whereby the control relay (40) and timing motor (28) will continue to be activated after the initial electrical current is no longer supplied.

15. The method specified in claim 14 wherein the step of activating the milk agitator (12) for the selected agitating period includes driving a second timer switch (42) by means of the timing motor (28), the second timer switch (42) being adapted to close for the selected agitating period, to direct electrical current to and thus activate the milk agitator (12), and then to open, to deactivate the milk agitator (12).

16. The method specified in claim 15 wherein the step of activating means for directing electrical current to the receptacle (22) in automatic coordination with the agitator (12) includes driving a third timer switch (44) by means of the timing motor (28), the third timer switch (44) being adapted to close at a selected time after the second timer switch (42) opens, and, when in its closed position, to direct electrical current to and thus activate the receptacle (22) to power the pump (18).

17. The method specified in claim 15 wherein the step of activating means for directing electrical current to the receptacle (22) in automatic coordination with the agitator (12) includes driving a third timer switch (44) by means of the timing motor (28), the third timer switch (44) being adapted to close at a selected time after the second timer switch (42) opens, and, when in its closed position, to activate a receptacle relay (48), which then directs electrical current of a selected voltage to the receptacle (22).

18. The method specified in claim 16 or 17 wherein the first, second, and third timer switches (36, 42, 44) each have an initial, open position, and including the step of returning the timer switches (36, 42, 44) to their initial positions automatically when the timing motor (28) ceases to drive them.

19. The method specified in claim 18 wherein the step of returning the timer switches (36, 42, 44) to their initial positions includes disengaging a timing motor clutch (34) adapted to engage the timing motor (28) with the timer switches (36, 42, 44), to cause the timing motor (28) to cease to drive the switches (36, 42, 44).

20. The method specified in claim 19 wherein the clutch (34) is adapted to be engaged only when electrical current is directed to the timing motor (28), and including the step of opening the first timer switch (36) automatically after the third timer switch (44) has been closed for a selected time to interrupt the electrical current directed therethrough to the timing motor (28) and to the control relay coil (38), whereupon the clutch (34) disengages and the timing motor (28) ceases to drive the timer switches (36, 42, 44), which then return to their initial positions, and the control relay (40) is deactivated and thus opens.

21. The method specified in claim 18 including the step of interrupting the flow of electrical current passing through the closed control relay (40) and closed first timer switch (36) to the timing motor (28) and to the control relay coil (38), whereupon the control relay (40) opens and the timing motor (28) ceases to drive the timer switches (36, 42, 44), which then return to their initial positions.

22. The lockout system (10) of claim 1 wherein the electrical receptacle (22) is of a standard design of common and unspecified application.

* * * * *